United States Patent [19]

Tsuchiya et al.

[11] Patent Number: 4,672,505

[45] Date of Patent: Jun. 9, 1987

[54] CORONA DISCHARGING DEVICE

[75] Inventors: Hiroaki Tsuchiya, Yokohama; Kimio Nakahata, Kawasaki, both of Japan

[73] Assignee: Canon Kabushiki Kaisha, Tokyo, Japan

[21] Appl. No.: 744,149

[22] Filed: Jun. 13, 1985

[30] Foreign Application Priority Data

Jun. 18, 1984 [JP] Japan ..... 59-124932

[51] Int. Cl.[4] ..... H01T 19/00; G03G 15/02

[52] U.S. Cl. ..... 361/235; 355/3 CH; 250/324; 250/326; 361/225

[58] Field of Search ..... 361/235, 225, 230, 229, 361/213; 250/324–326; 355/3 CH

[56] References Cited

U.S. PATENT DOCUMENTS 3,760,229 9/1973 Silverberg ..... 361/213

3,790,854 2/1974 Dryczynski et al. ..... 361/213

4,042,874 8/1977 Quinn et al. ..... 361/225 X 4,456,365 6/1984 Yuasa ..... 361/225 X

*Primary Examiner*—L. T. Hix

*Assistant Examiner*—D. Rutledge

*Attorney, Agent, or Firm*—Fitzpatrick, Cella, Harper & Scinto

[57] ABSTRACT

A corona discharging device having a corona discharging electrode to which a high voltage is applied to produce corona discharge. The high voltage applied to the corona discharging electrode is provided by superposing an AC voltage to a DC voltage. The DC voltage and the AC voltage are determined such that the corona discharging current has only the polarity which is the same as that of the DC component voltage. The corona discharge is stabilized and hardly produces a non-uniform discharge.

26 Claims, 19 Drawing Figures

CORONA DISCHARGING DEVICE

BACKGROUND OF THE INVENTION

The present invention relates to a corona discharging device having a corona discharging electrode to which a high voltage is applied so that corona discharge takes place, and more particularly to a corona discharging device which is usable with an electrophotographic apparatus such as an electrophotographic copying machine and a laser beam printer and which is actable on a photosensitive member to electrically charge the same.

A corona discharging device wherein the corona discharge is effected by applying a high voltage to a corona discharging electrode, is divided into three categories from the standpoint of the voltage applied thereto.

In the first category, a DC voltage is applied to the corona discharging electrode. A DC high voltage of positive polarity is applied to produce a positive corona, while a negative high DC voltage is applied to produce a negative corona.

In the second category, an AC voltage is applied to the corona discharging electrode, whereby both positive and negative coronas are produced by the corona discharging electrode.

In the third, an AC voltage and a DC voltage which are superposed with each other are applied to the corona discharging electrode. In this case, the main part is the AC voltage producing the positive and negative corona. The difference in the corona discharge (current) between the two components is effective to discharge the surface to be charged. Here, the DC voltage is auxiliary and is effective to control the difference in the corona discharge current between the negative component and positive component, or to maintain the difference constant.

When a corona discharging device is used for charging to a desired potential a member to be charged such as a photosensitive member, the first category discharger is most frequently used. However, when a DC voltage is applied to the corona discharging electrode to produce a negative corona, non-uniform discharge takes place unless the corona discharging current from the corona discharging electrode is significantly increased. Therefore, with the view to increasing the corona discharging current, it is necessary to increase the output and the capacity of the high voltage power source, resulting in a large size high voltage source. The increase of the discharging current involves an additional drawback that the corona products such as ozone and nitrogen oxide are also increased. The problems described above arise also in the case of positive corona discharge, although they are relatively less as compared with the negative corona.

It would be considered that the third category device is used to effect the charging. However, since the charging action is provided by the difference in the corona discharging current between the positive and negative components in this device, the charging efficiency is low when the surface is charged to a certain polarity.

SUMMARY OF THE INVENTION

Accordingly, it is a principal object of the present invention to provide a corona discharging device wherein a stabilized corona discharge is produced with less discharge non-uniformity and with a low corona discharging current, which does not require increasing the output or capacity of the high voltage source.

It is another object of the present invention to provide a corona discharging device which produces less corona products such as ozone and nitrogen oxide.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

The preferred embodiments of the present invention will be described in conjunction with the accompanying drawings.

Figure 1:
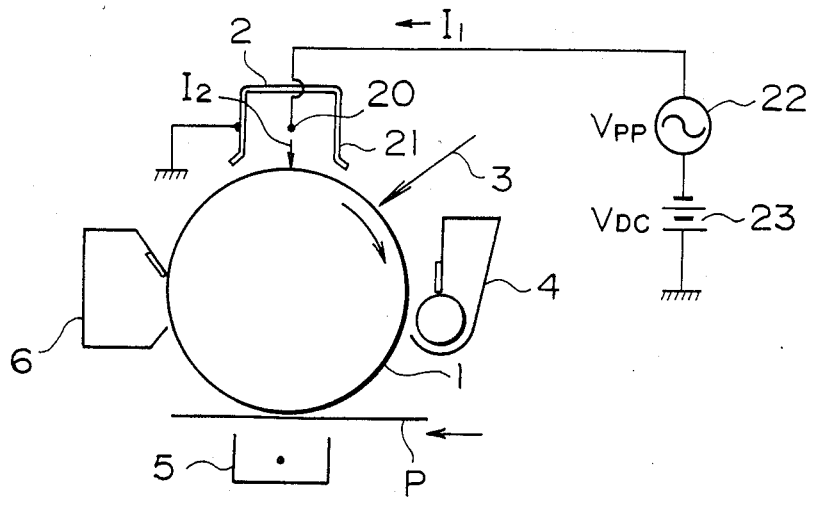
FIG. 1 is a cross-sectional view of an electrophotographic copying apparatus with which the corona discharging device according to an embodiment of the present invention is used.

Referring to FIG. 1, there is shown an electrophotographic copying apparatus used with a corona discharging device according to an embodiment of the present invention.

The copying apparatus comprises a photosensitive drum 1 which is a member to be charged in this case and which is rotatable in the direction indicated by an arrow at a predetermined circumferential speed. The apparatus further comprises a corona discharging device 2 according to the embodiment of the present invention which is effective to uniformly charge the surface of the photosensitive drum 1. The photosensitive drum 1, after being uniformly charged, is exposed to image light 3 corresponding to an original to be copied, so that an electrostatic latent image is formed on the photosensitive member. The electrostatic latent image is visualized by a developing device 4, and the developed image is transferred by a transfer charger 5 onto a transfer material P transported in the direction indicated by an arrow thereto by an unshown transporting mechanism. After the image transfer operation, the transfer material P is conveyed to an unshown image fixing device, where the image is fixed thereon. Then, the transfer material is discharged from the copying apparatus. On the other hand, the developer remaining on the surface of the photosensitive drum 1 is removed therefrom by a cleaning device 6, so that the photosensitive drum 1 is prepared for the next image formation. In this manner, the photosensitive drum 1 is subjected to predetermined process steps for the formation of an image.

The corona discharging device 2 will be described in detail. The corona discharging device 2 comprises as shown in FIG. 1 a corona discharging wire 20 as the corona discharging electrode and a shield 21. The corona discharging wire 20 is electrically connected to an AC high voltage source 22 and a DC high voltage source 23 which are connected in series with each other. Using both voltage sources 22 and 23, the corona discharging wire 20 is supplied with a DC high voltage $V_{DC}$ to which an AC voltage Vpp is superposed. In this embodiment, the shield 21 is grounded.

In this embodiment, the distance between the lateral inner wall surface of the shield plate 21 and the corona discharging wire 20 is approximately 7 mm; the distance between the backside inner wall surface of the shield 21 and the corona discharging wire 20 is approximately 8 mm; the distance between the corona discharging wire 20 and the surface of the photosensitive member 1 is approximately 10 mm; the diameter of the corona discharging wire 21 is approximately 60 microns. The peripheral speed of the photosensitive drum 1 is approximately 66 mm/sec. The material of the photosensitive drum 1 is an organic photoconductor (OPC).

As for the voltage applied to the corona discharging wire 20, the output Vpp of the AC high voltage source 22 had a frequency of approximately 400 Hz (sine wave) and a peak-to-peak voltage of approximately 6 KVpp, and the output $V_{DC}$ of the DC source 23 had a voltage of approximately −3.5 KV. Voltages were superposed. By supplying the superposed voltage to the corona discharging wire 20, a negative corona discharge current $I_2$ is produced from the corona discharging wire 20 to the photosensitive member 1 so that the surface of the photosensitive member 1 was negatively charged. Thus, the photosensitive member 1 was charged to approximately −800 V. The current $I_1$ shown in FIG. 1 is the total corona current.

Figure 2:
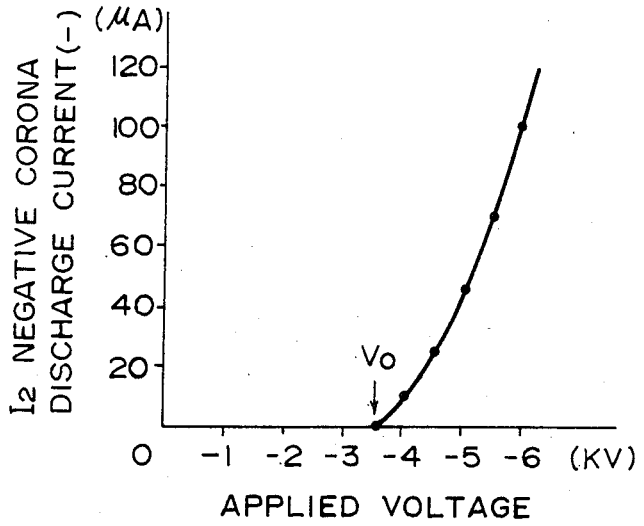
FIG. 2 is a graph showing the discharging current with respect to the applied voltage in the corona discharging device of FIG. 1.

FIG. 2 shows the relation between the voltage applied to the corona discharging wire 20 and the negative corona discharge current $I_2$ to the photosensitive member 1. Indicated by $V_0$ is a corona discharge on-set voltage (approximately −3.5 KV). As will be understood, the output voltage $V_{DC}$ of the DC power source 23 is about the same as the voltage $V_0$. Since the positive peak voltage of the AC voltage provided by the AC high voltage source 22 is +3.0 KV, and the negative peak thereof is −3.0 KV, no AC discharging takes place with the AC voltage source 22 alone. Since the positive on-set voltage is larger than the negative on-set voltage, no positive discharging occurs. In this embodiment, the corona discharging current $I_2$ required for the photosensitive member surface to be charged to −800 V is approximately −50 μA. The required current is provided by the DC voltage $V_{DC}$ and the AC voltage Vpp superposed thereto.

Figure 3A:
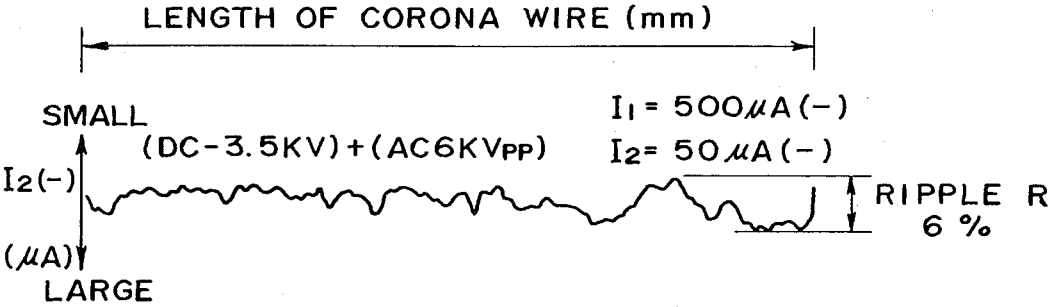
FIG. 3A is a graph showing a distribution of the discharging current in the corona discharging device of FIG. 1.
Figure 3B:
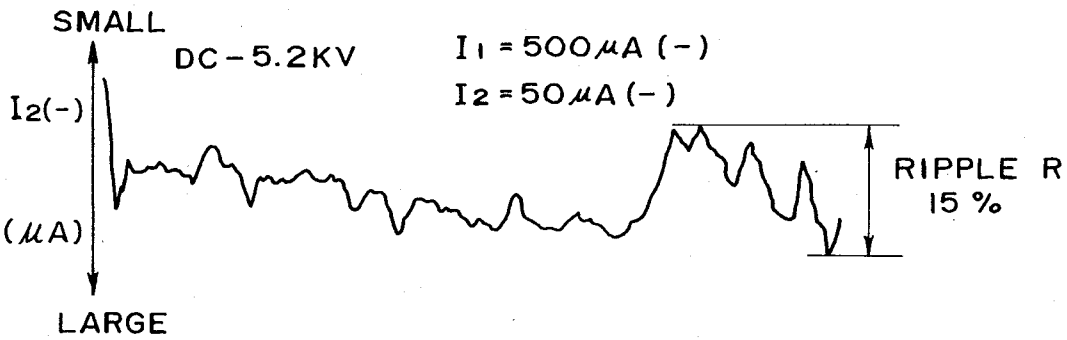
FIG. 3B is a graph showing the distribution of the discharging current in the corona discharging device to which only a high DC voltage is applied.
Figure 4B:
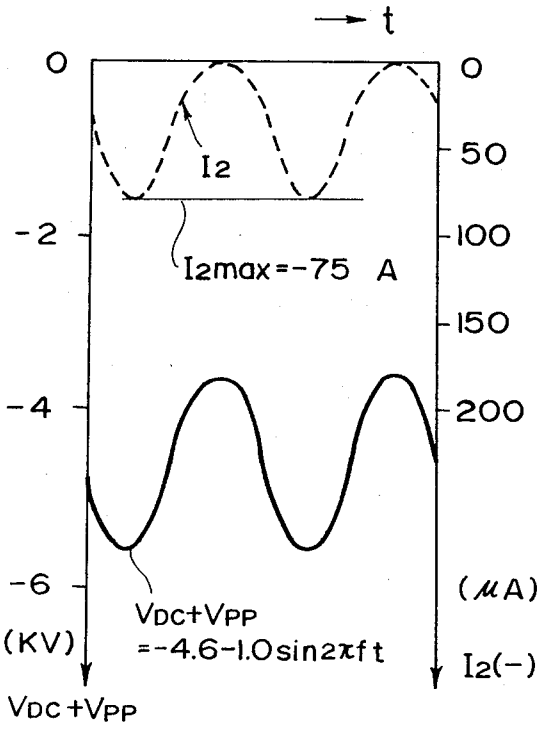
FIGS. 4A, 4B, 4C, 4D, 4E, 4F and 4G are graphs showing the wave form of the applied voltage and the discharging current with respect to time.
Figure 4A:
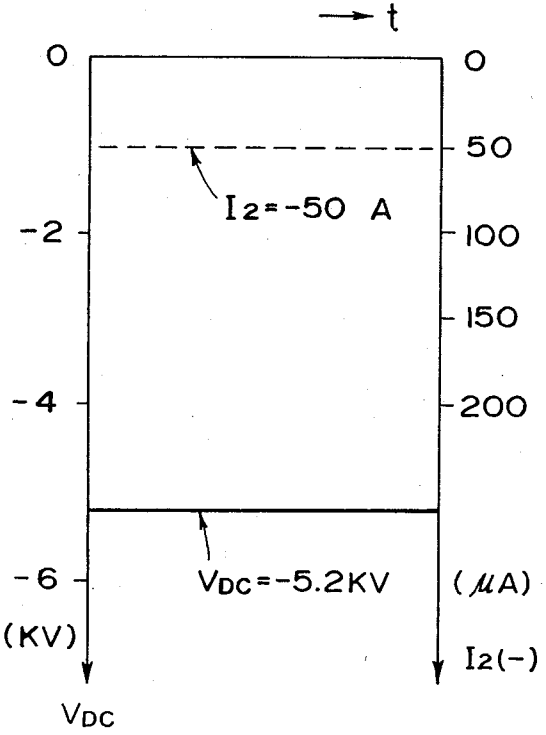
Figure 4D:
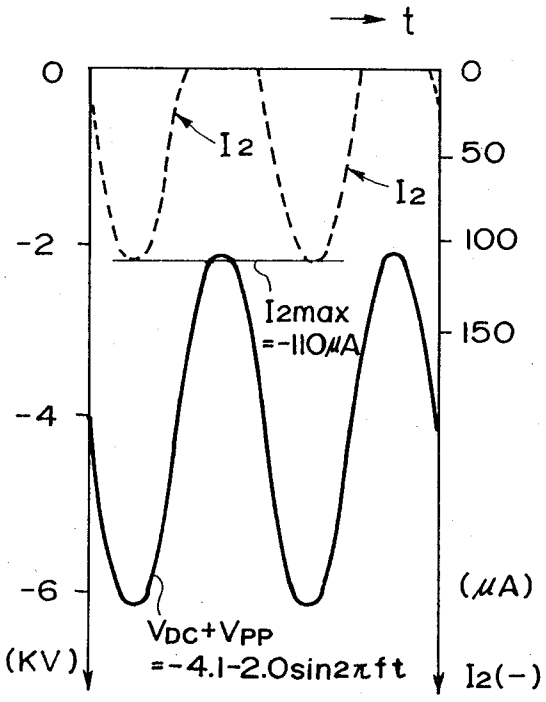
Figure 4C:
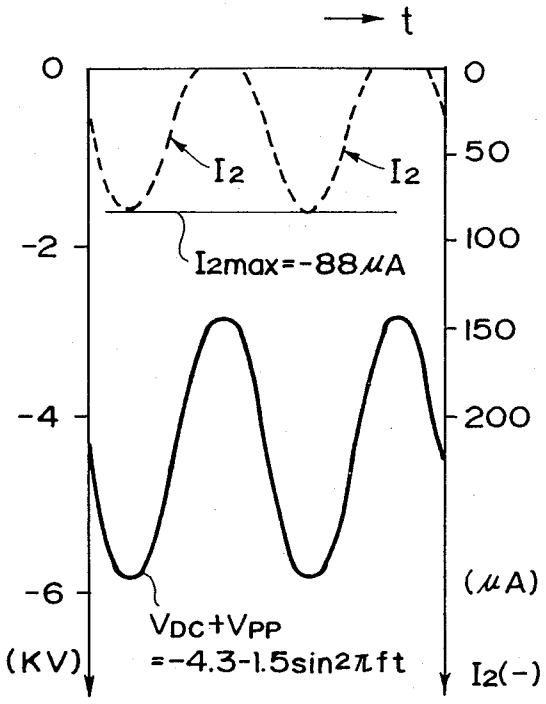
Figure 4F:
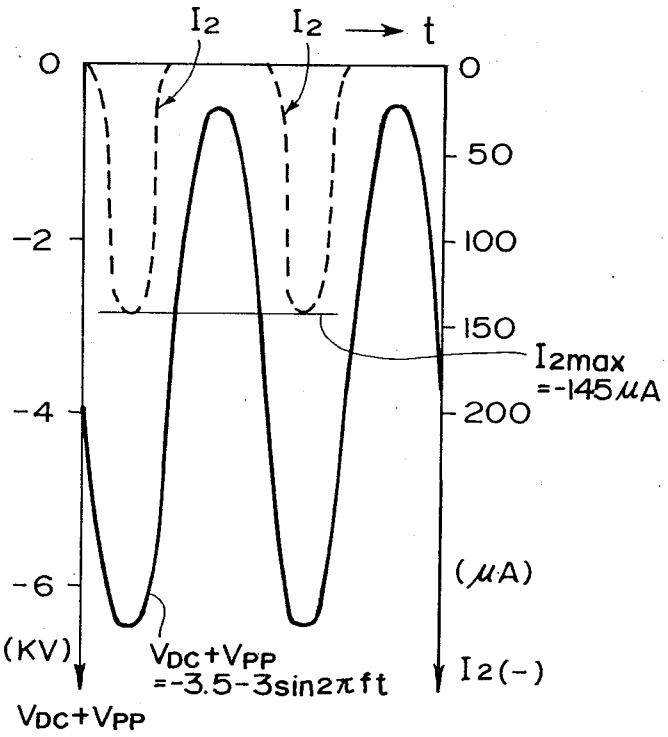
Figure 4E:
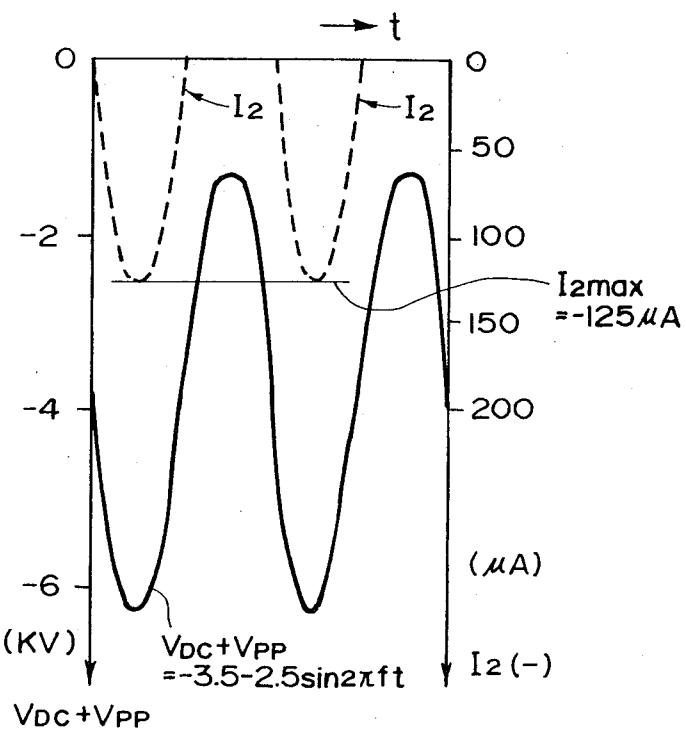
Figure 4G:
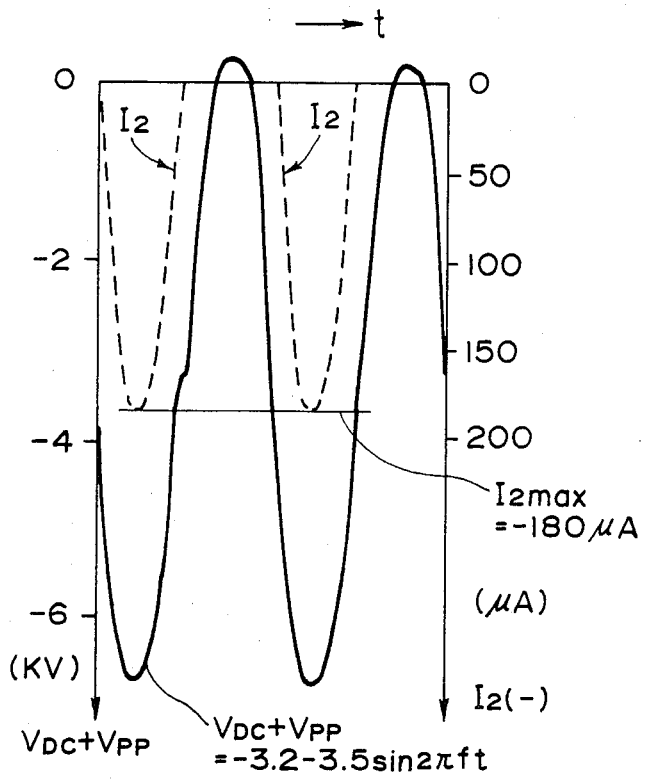

Referring now to FIGS. 3A and 3B, the difference in the unevenness will be described between the corona discharging device according to this embodiment and a corona discharging device having a corona discharging wire to which only a DC voltage is applied.

FIG. 3A shows a distribution, along the length of the corona discharging wire 20, of the discharging current $I_2$ to the photosensitive member 1 when the corona discharging wire 20 is supplied with the superposed DC voltage (−3.5 KV) and AC voltage (6 KVpp). FIG. 3B shows, as a comparison, the same distribution when the corona discharging wire 20 is supplied only with a DC voltage $V_{DC}$ (−5.2 KV) to effect the negative corona discharging, the DC voltage of −5.2 KV being effective to provide the corona discharging current of 50 μA.

In both cases, the total corona discharging current $I_1$ was approximately 500 μA (negative). The FIG. 3A case exhibits a ripple R of approximately 6% as shown in FIG. 3A, whereas the ripple R of FIG. 3B case was 15%. It follows that the distribution of the discharging current along the length of the corona discharging wire is more uniform when the corona discharging wire 20 is supplied with the superposed DC voltage and AC voltage ($V_{DC}$+Vpp) than when it is supplied with a DC voltage $V_{DC}$ alone.

The above described ripple R (%) is defined as (B/A)×100 (%), where "A" is the maximum current in the distribution, and "B" is the maximum difference or variation of the current. When the ripple R is not more than 10%, there is practically no problem so that the image can be formed substantially without unevenness.

Table 1 below shows the results of image uniformity with respect to the ripple R of the discharging current distribution along the length of the corona discharging wire when the image forming operation was actually carried out with the superposed DC high voltage $V_{DC}$ and AC high voltage Vpp which were combined so as to provide a constant corona discharging current (−50 μA) in this example.

TABLE 1

| | $V_{DC}$ (KV) | Vpp (KV) | Peak of $V_{DC}$ + Vpp (KV) | R (%) | Image Uniformity |
|---|---|---|---|---|---|
| (a) | −5.2 | 0 | −5.2 | 15 | B |
| (b) | −4.6 | 2.0 | −5.6 | 12 | B |
| (c) | −4.3 | 3.0 | −5.8 | 10 | F |
| (d) | −4.1 | 4.0 | −6.1 | 8 | G |
| (e) | −3.8 | 5.0 | −6.3 | 7 | G |
| (f) | −3.5 | 6.0 | −6.5 | 6 | G |
| (g) | −3.2 | 7.0 | −6.7 | 6 | G |

B: Not Practicable
F: Substantially Practicable
G: Good

FIGS. 4A, 4B, 4C, 4D, 4E, 4F and 4G show the wave form of the applied voltage and that of the discharging current, and they correspond to (a), (b), (c), (d), (e), (f) and (g) of the above Table.

It is evident from the Table, the AC voltage Vpp superposed to the DC voltage $V_{DC}$ is effective to provide a practicable image if it is approximately 3 KV and higher. If it is not less than 4 KV, the non-uniformity of the image is substantially unrecognizable. It is preferable to avoid increasing the AC voltage Vpp more than necessary, in order to prevent occurrence of the spark discharging. In this example, it is determined that 7 KV is the upper limit in consideration of the spark discharging so that the experiments have been carried out upto 7 KV. The results indicate no significant difference in the range from 4 KVpp to 7 KVpp.

Also, it is evident from FIGS. 4A–4G, as compared with the case of the DC voltage $V_{DC}$ alone, that the ripple R and therefore the image non-uniformity decreases as the maximum corona discharging current $|I_{2max}|$ increase.

As a general criterion for determining the voltage to be superposed, the DC voltage $V_{DC}$ and the AC voltage Vpp are so determined that the maximum corona discharging current $I_{2max}$ is not less than approximately twice the corona discharging current $I_2$ ($-50$ μA in this embodiment) with the DC voltage $V_{DC}$ only. As another criteria, the DC voltage $V_{DC}$ is made close to the on-set voltage $V_0$ ($-3.5$ KV in this example), and the AC voltage Vpp is superposed thereto which is approximately 1–2 times the on-set voltage $V_0$, that is, 4–7 KV is superposed in this example. By the determination in this manner, the non-uniformity can be reduced. Thus, according to the embodiment of the present invention, the DC component voltage and the AC component voltage are determined such that the corona discharging current when the superposed voltage is applied to the corona discharging wire is equivalent to the corona discharging current provided when the DC voltage alone is applied to the corona discharging wire. (The "equivalent" includes the tolerance of ±5% of the current when the DC voltage alone is used.) Further, in this embodiment of the invention, the peak voltage of the superposed voltage waveform is set such that it is lower than a spark discharge voltage (approximately 7 KV in this example) which is determined depending on the structure of the corona discharging device. Furthermore, in this embodiment, only the corona discharging current of the polarity which is the same as the polarity of the DC voltage flows. Therefore, the non-uniformity in the discharging is reduced as compared with the case where only a DC voltage is applied to the corona discharging wire.

The reasons for the stabilized discharging provided by the superposition of the DC high voltage and the AC voltage are considered to be as follows. Particularly with respect to negative corona discharge, the ripple in the corona discharge distribution is inversely proportional to the amount of the corona discharging current. Between the ripple R and the corona discharging current $I_2$ flowing to the photosensitive member, there is a relation, $R \times I_2 = C$, where C is a constant peculiar to a particular corona discharging wire although it changes depending on the conditions of the corona discharging wire (i.e., the surface conditions, the degree of dirtiness, the diameter thereof and so on). It is understood, therefore, that the ripple R decreases with increase of the corona discharging current $I_2$.

The corona discharging current $I_2$ is the one determined on the basis of the maximum current $I_{2max}$ resulting from the superposed DC voltage and AC voltage, and is not such a constant current as results from a DC high voltage alone. This will be described with respect to FIG. 5.

Figure 5:
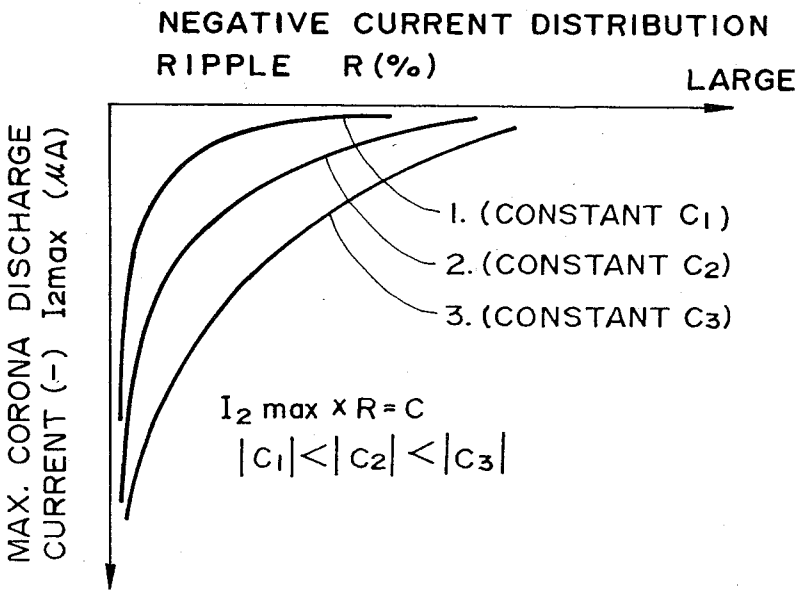
FIG. 5 is a graph showing the relation between the ripple of the discharging current distribution and the maximum discharging current.

In FIG. 5, the uppermost curve is achieved with a clean discharging wire; the lowermost one is achieved with a dirty discharging wire; the curve in between is achieved with a wire of medium dirtiness. The above described constant is determined for each of the curves, and $|C_1| < |C_2| < |C_3|$. With a constant $I_{2max}$, the ripple R is smaller if $|C|$ is smaller; and more stable discharging can be provided. With the constant C fixed, the ripple R is smaller if the maximum discharging current $|I_{2max}|$ is larger; and more stable discharging can be provided.

In the present invention, the procurement, by the superposed voltages, of the corona discharging current which is effectively equivalent (in the integration of the current) to the corona discharging current obtained with a DC voltage alone, necessarily results in the increase of the maximum discharging current $I_{2max}$. It is considered that this is effective to stabilize the corona discharging action.

Figure 6:
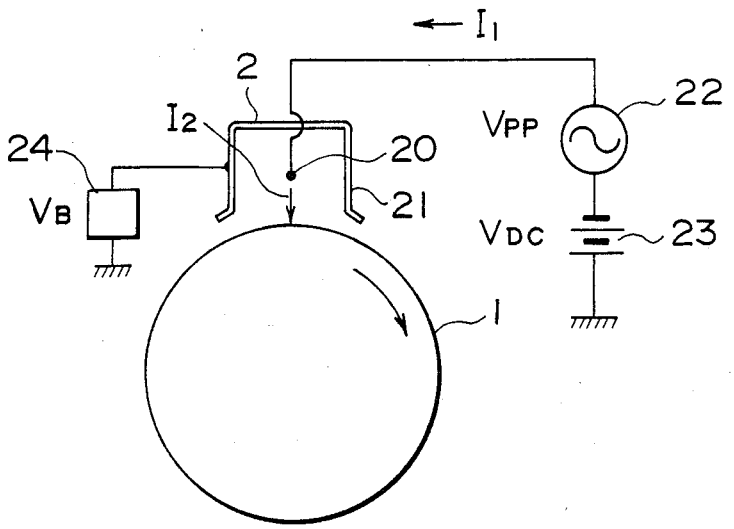
FIG. 6 is a cross-sectional view of a corona discharging device according to a second embodiment of the present invention.

FIG. 6 shows a corona discharging device according to another embodiment of the present invention, wherein a bias voltage $V_B$ having the same polarity as the DC high voltage source 23 is applied to the shield 21 of the corona discharging device 2 by a bias source 24. By doing so, the total corona current $I_1$ can be reduced. Since the structures of the corona discharging device of this embodiment in the other respects are similar to FIG. 1 embodiment, the detailed description thereof is omitted for the sake of simplicity by assigning the same reference numerals to the corresponding elements. The bias voltage $V_B$ may be applied by a voltage element of linear or non-linear type, such as a varistor and a constant voltage diode. The description of the imaging process is omitted for the same reason.

The voltage applied to the corona discharging wire 20 was the same as in the foregoing embodiment, $V_{DC} = -3.5$ KV, Vpp = 6 KVpp, and the frequency of the sine wave form of approximately 400 Hz. The bias voltage $V_B$ was $-1$ KV. The total corona current $I_1$ was reduced to $-200$ μA, but the corona discharging current $I_2$ was the same as the foregoing embodiment, that is, $-50$ μA resulting in the equivalent surface potential of the photosensitive member.

Figure 7:
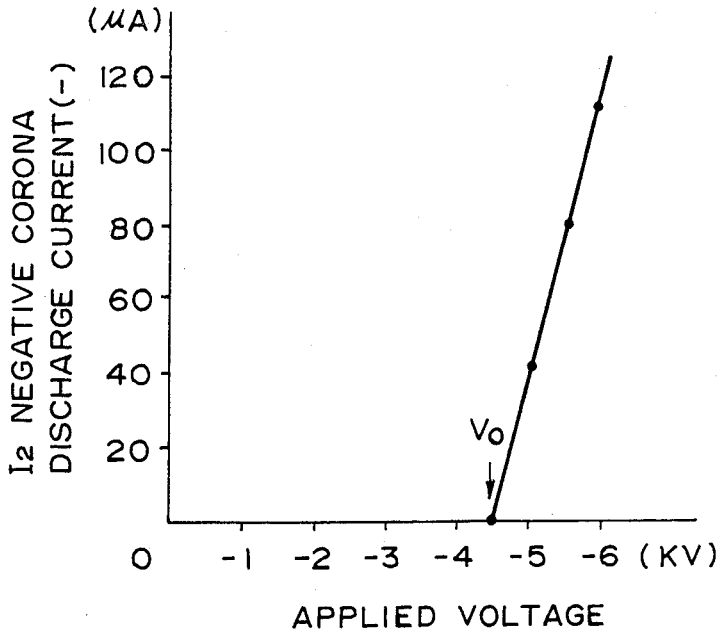
FIG. 7 is a graph showing the discharging current with respect to the applied voltage in the corona discharging device of FIG. 6.

FIG. 7 shows the relation between the voltage applied to the corona discharging wire 20 and the negative corona discharging current $I_2$ to the photosensitive member 1 in this embodiment.

Figure 8A:
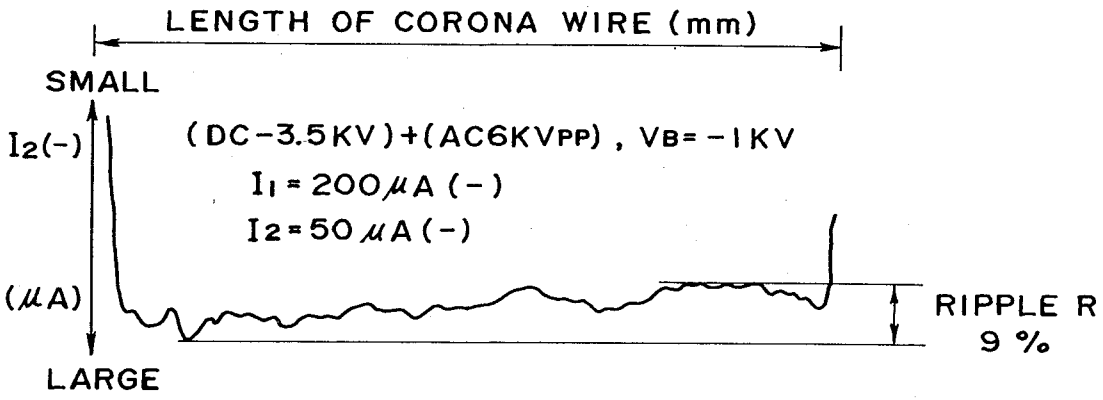
FIG. 8A is a graph showing the distribution of the corona discharging current of the corona discharging device of FIG. 6.
Figure 8B:
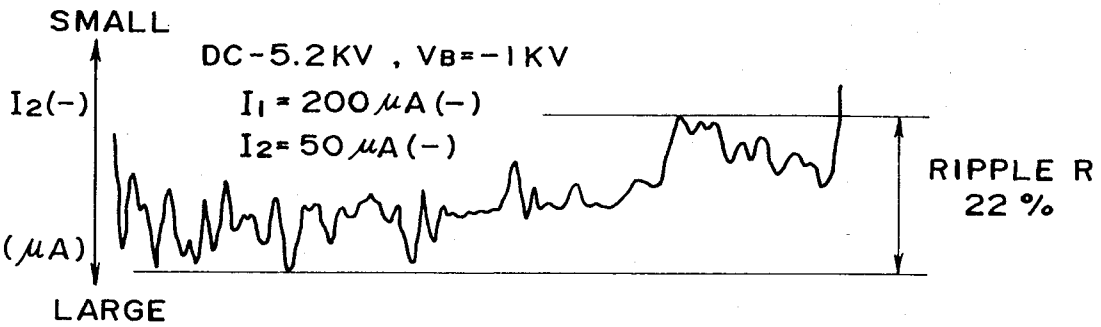
FIG. 8B is a graph showing the distribution of the discharging current in a corona discharging device to which only a high DC voltage is applied.

FIG. 8A shows the distribution of the discharging current $I_2$ to the photosensitive member 1 along the length of the corona discharging wire 20 under the above described voltage conditions, and FIG. 8B shows as a comparison the same distribution of the corona discharging current $I_2$ produced when only the DC voltage of $-5.2$ KV is applied to the corona discharging wire 20, and the bias voltage $V_B$ of $-1$ KV is applied to the shield 21 to execute negative corona discharge ($I_1 = -200$ μA and $I_2 = -50$ μA). As will be understood, the ripple R in the case of FIG. 8A is approximately 9% which is in the practicable range, but that of FIG. 8B is 22% which is far from the practicable range.

Thus, according to this embodiment, the total corona current can be reduced by the bias voltage applied to the shield, and the discharging non-uniformity can still be reduced by applying a superposed DC high voltage and AC voltage.

Figure 9:
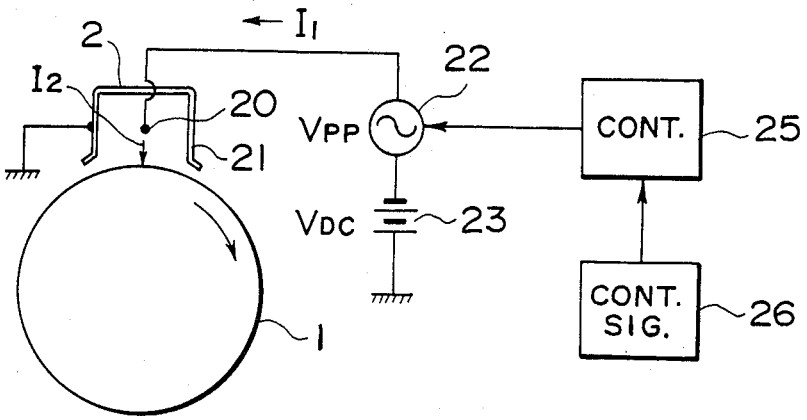
FIG. 9 is a cross-sectional view of a corona discharging device according to a third embodiment of the present invention.

FIG. 9 illustrates a further embodiment of the present invention.

Figure 10:
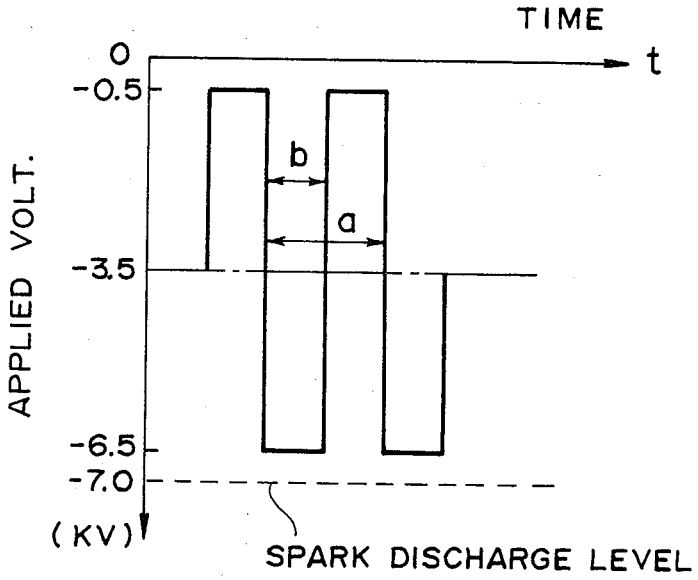
FIG. 10 is a graph showing the wave form of the applied voltage to the corona discharging device of FIG. 9.

FIG. 10 shows a voltage applied to the corona discharging wire 20 of FIG. 9 in this embodiment. The applied voltage was in the form of an AC voltage Vpp having the frequency of approximately 400 Hz and the peak-to-peak voltage of 6 KVpp superposed to a DC voltage $V_{DC}$ of approximately −3.5 KV. The AC voltage was in the form of a rectangular wave. To the AC high voltage source 22, a control circuit 25 is connected so as to change the duty ratio (which will be described hereinafter) of the rectangular wave. The control circuit 25 is connected to a control signal generating source 26 which is effective to input a control signal to the control circuit 25. The control signal from the control signal generating source 26 is produced on the basis of a signal from a corona discharging current detecting circuit, for example, when the corona discharging current is to be made constant. Or, it is produced on the basis of a signal from a potential sensor when the potential is to be controlled.

The "duty ratio" is defined as (b/a)×100 (%), "b" and "a" being as shown in FIG. 10. In this embodiment, the duty ratio is approximately 50% as will be understood from FIG. 10.

Figure 11:
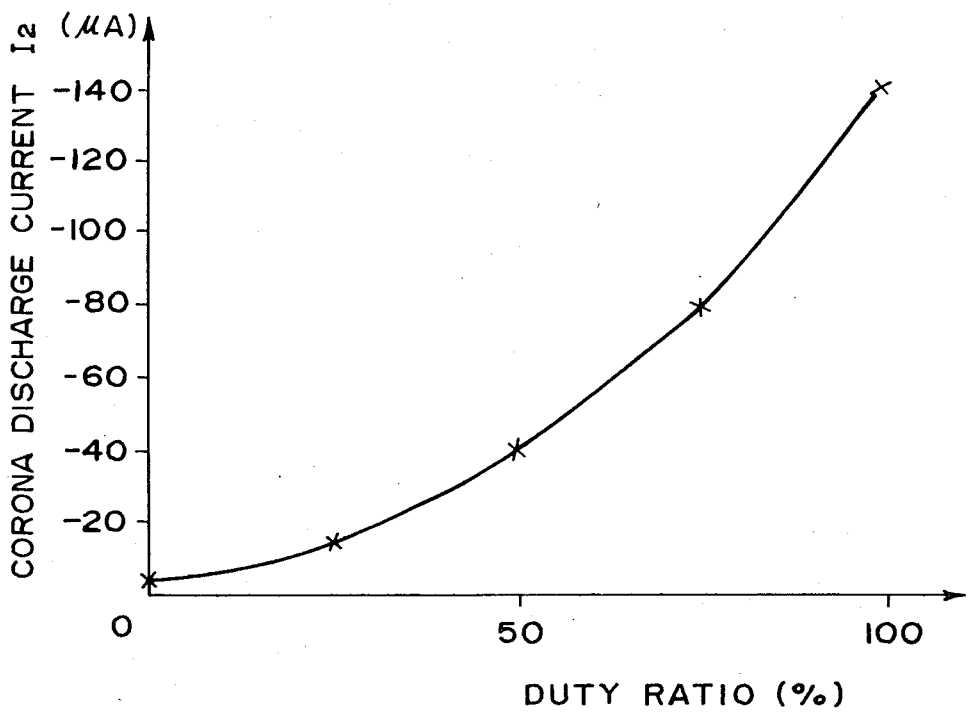
FIG. 11 is a graph showing the relation between the corona discharging current and a duty ratio.

FIG. 11 illustrates the change in the current $I_2$ when the duty ratio is changed. As will be evident from this Figure, the total corona current $I_1$ or the current $I_2$ flowing to the photosensitive member 1 is increased by increasing the duty ratio, while they are reduced by reducing the duty ratio. In the embodiment illustrated, the peak voltage of the voltage applied to the corona discharging wire 20 is −6.5 KV and is constant, so that the discharg non-uniformity hardly changes even if the duty ratio is reduced.

Thus, the corona discharging current can be controlled with the advantage of the reduced discharging non-uniformity by changing the duty ratio of the pulse wave with the constant DC high voltage and AC high voltage.

As described in the foregoing, according to this embodiment, when a desired surface potential on the photosensitive member is to be provided by a negative corona discharge, that is, when a desired negative corona discharging current is to be provided to the photosensitive member, the ripple R of the discharging current is lower, than if the corona discharge is produced by a high DC voltage alone, if the negative corona discharge current, which is effectively equivalent to the corona discharge current obtained by the high DC voltage alone, is produced by the superposed DC high voltage and AC voltage. Even in the case of such a low corona discharging current, as is not sufficient to provide a practicable corona discharge by the conventional DC high voltage, stabilized and uniform corona discharging can be obtained by the corona discharging current of a desired charging polarity provided by the superposed DC high voltage and AC voltage.

In addition, since the corona discharging is effected with a relatively lower current, the corona discharging products such as ozone and nitrogen oxide are significantly reduced, whereby the photosensitive member or the like is protected from the deterioration by the corona products.

In the foregoing, the description has been made with respect to the case where the negative corona discharge is produced, but this is not limiting. The present invention is applicable to a positive corona discharge, although it is particularly effective when the negative corona discharge is used.

In the foregoing description, the sine waveform and a rectangular waveform have been taken as the waveform of the AC voltage, but another waveform such as a triangular wave and a pulse wave may be used.

From the standpoint of maintaining the maximum corona discharging current $I_{2max}$, the apex of the voltage waveform is preferably flat rather than in the form of a spike.

Furthermore, the bias voltage $V_B$ applied to the shield is not limited to a DC voltage or to an AC voltage. Additionally, the present invention is applicable to a charger provided with a grid electrode.

While the invention has been described with reference to the structures disclosed herein, it is not confined to the details set forth and this application is intended to cover such modifications or changes as may come within the purposes of the improvements or the scope of the following claims.

What is claimed is:

1. A corona discharging device, comprising:

a corona discharging electrode; and a voltage source for applying a voltage to said corona discharging electrode, the voltage source providing a voltage in the form of a superposition of a component of a DC voltage and a component of an AC voltage, the superposed voltage being effective to produce a corona discharging current only of a polarity which is the same as that of the DC voltage component.

2. A device according to claim 1, wherein said superposed voltage is determined when a level of charged potential is to be obtained, such that the superposed voltage is effective to produce the corona discharging current which is equivalent to a corona discharging current which is to be produced if the level of the potential is provided by the corona discharging electrode with a DC voltage alone.

3. A device according to claim 2, wherein said superposed voltage is determined such that the maximum of the corona discharging current by the superposed voltage is substantially not less than 2×I, where I is the corona discharging current if said level is to be obtained by the DC voltage alone.

4. A device according to claim 1, wherein said superposed voltage is determined such that the maximum of the corona discharging current is substantially not less than 2×I, when a level of a charged potential is to be provided, where I is a corona discharging current required when said level of the charged potential is provided by said corona discharging electrode if supplied with a DC voltage alone.

5. A device according to any one of claims 1–4, wherein the DC voltage of said superposed voltage is close to an on-set voltage of said corona discharging device, and said AC voltage has a peak-to-peak voltage substantially 1–2 times the DC voltage.

6. A device according to claim 5, wherein the peak of the superposed voltage is less than a spark discharge starting voltage.

7. A device according to claim 5, wherein the DC voltage of said superposed voltage is of the negative polarity.

8. A device according to any one of claims 1–4, wherein the DC voltage of said superposed voltage is of the negative polarity.

9. A device according to claim 1, further comprising a shield member surrounding said corona discharging electrode, wherein a bias voltage is applied to said shield member.

10. A device according to claim 1, further comprising control means for controlling the corona discharging current by changing a duty ratio of the AC voltage with the voltage levels of the DC voltage and AC voltage constant.

11. A device according to claim 10, wherein the AC voltage is in the form of a rectangular wave.

12. A device according to claim 1, wherein AC voltage has peak-to-peak voltage of not less than 3 KV.

13. A device according to claim 1, wherein said AC voltage has a peak-to-peak voltage of not less than 4 KV and not more than 7 KV.

14. A device according to claim 1, wherein said device is disposed opposite to a photosensitive member of an image forming apparatus and disposed adjacent an image exposure station thereof where a latent image is formed.

15. A device according to claim 14, wherein said device provides a discharging current distribution in a longitudinal direction thereof, in which a ripple is not less than 10%.

16. A device according to claim 1, wherein said device is disposed opposite to a photosensitive member of an image forming apparatus and is effective to transfer a developed image from the photosensitive member to a transfer material.

17. A corona discharging device usable with an electrophotographic apparatus wherein an electrostatic photographic photosensitive member passes by a charging station, an exposure station, a developing station and an image transfer station sequentially to form an image, said corona discharging device charging the photosensitive member to a negative polarity at said charging station, said corona discharging device comprising:

a corona discharging electrode; and a voltage source for applying a voltage to said corona discharging electrode, said voltage source providing a voltage in the form of a superposition of a component of a negative DC voltage and a component of an AC voltage, said superposed voltage being effective to produce a corona discharging current, to said photosensitive member, of the negative polarity only.

18. A device according to claim 17, wherein said superposed voltage is determined when a level of charged potential is to be obtained, such that the superposed voltage is effective to produce the corona discharging current which is equivalent to a corona discharging current which is to be produced if the level of the potential is provided by the corona discharging electrode with a DC voltage alone.

19. A device according to claim 18, wherein said superposed voltage is determined such that the maximum of the corona discharging current by the superposed voltage is substantially not less than $2\times I$, where I is the corona discharging current if said level is to be obtained by the DC voltage alone.

20. A device according to claim 17, wherein said superposed voltage is determined such that the maximum of the corona discharging current is substantially not less than $2\times I$, when a level of a charged potential is to be provided, where I is a corona discharging current required when said level of the charged potential is provided by said corona discharging electrode if supplied with a DC voltage alone.

21. A device according to any one of claims 17–20, wherein the DC voltage of said superposed voltage is close to an on-set voltage of said corona discharging device, and said AC voltage has a peak-to-peak voltage substantially 1–2 times the DC voltage.

22. A device according to claim 21, wherein the peak of the superposed voltage is less than a spark discharge starting voltage.

23. A device according to claim 17, further comprising a shield member surrounding said corona discharging electrode, wherein a bias voltage is applied to said shield member.

24. A device according to claim 23, wherein the AC voltage is in the form of a rectangular wave.

25. A device according to claim 17, further comprising control means for controlling the corona discharging current by changing a duty ratio of the AC voltage with the voltage levels of the DC voltage and AC voltage constant.

26. A device according to claim 17, wherein said photosensitive member is of an organic photoconductor.

* * * * *

UNITED STATES PATENT AND TRADEMARK OFFICE

CERTIFICATE OF CORRECTION

PATENT NO. : 4,672,505

DATED : June 9, 1987

INVENTOR(S) : Hiroaki Tsuchiya, et al.

It is certified that error appears in the above-identified patent and that said Letters Patent is hereby corrected as shown below:

COLUMN 2

Line 28, "wave form" should read --waveform--.
Line 49, "wave form" should read --waveform--.

COLUMN 3

Line 41, "wire 21" should read --wire 20".
Line 50, "Voltages should read --Those voltages--.

COLUMN 4

Line 35, "above described" should read --above-described--.
Lines 63-64, "wave form" should read --waveform--.

COLUMN 5

Line 8, "upto" should read --up to--.
Line 15, "increase." should read --increases.--.

UNITED STATES PATENT AND TRADEMARK OFFICE

CERTIFICATE OF CORRECTION

PATENT NO. : 4,672,505

DATED : June 9, 1987

INVENTOR(S) : Hiroaki Tsuchiya, et al.

It is certified that error appears in the above-identified patent and that said Letters Patent is hereby corrected as shown below:

COLUMN 6

Line 3, "the" should read --and the--.
Lines 4-5, "above described" should read --above-described--.
Line 38, "wave form" should read --waveform--.
Line 51, "above described" should read --above-described--.

COLUMN 7

Line 32, "discharg" should read --discharge--.

Signed and Sealed this

Twenty-fourth Day of November, 1987

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,672,505

DATED : June 9, 1987

INVENTOR(S) : Hiroaki Tsuchiya et al.

It is certified that error appears in the above-identified patent and that said Letters Patent is hereby corrected as shown below:

Column 4, line 28, "of" should read --of the--.

Signed and Sealed this

Twenty-third Day of February, 1988

*Attest:*

DONALD J. QUIGG

*Attesting Officer*

*Commissioner of Patents and Trademarks*